US006733070B2

(12) United States Patent
Chang

(10) Patent No.: US 6,733,070 B2
(45) Date of Patent: May 11, 2004

(54) FOLDABLE CHAIR WITH RECLINING BACK

(75) Inventor: Tony Wei-Sin Chang, San Jose, CA (US)

(73) Assignee: TWSC Corp., San Jose, CA (US)

( * ) Notice: Subject to any disclaimer, the term of this patent is extended or adjusted under 35 U.S.C. 154(b) by 189 days.

(21) Appl. No.: 10/060,783

(22) Filed: Jan. 30, 2002

(65) Prior Publication Data

US 2004/0007903 A1 Jan. 15, 2004

(51) Int. Cl.[7] ..... A47C 4/00; A47C 4/28; B60N 2/02

(52) U.S. Cl. ..... 297/16.2; 297/21; 297/45; 297/363; 297/364; 297/365; 297/367; 297/368

(58) Field of Search ..... 297/16.2, 21, 45, 297/363, 364, 365, 367, 368, 369

(56) References Cited

U.S. PATENT DOCUMENTS 3,124,387 A * 3/1964 Mclaren ..... 297/16.2
5,797,655 A * 8/1998 Miles ..... 297/411.23
5,984,406 A * 11/1999 Lee ..... 297/16.2
6,149,238 A * 11/2000 Tsai ..... 297/411.43
6,168,553 B1 * 1/2001 Kuo ..... 482/57
6,209,951 B1 * 4/2001 Han ..... 297/45
6,264,271 B1 * 7/2001 Munn et al. ..... 297/45
6,296,304 B1 * 10/2001 Zheng ..... 297/45
6,419,311 B1 * 7/2002 Tang ..... 297/45
6,547,322 B2 * 4/2003 Marx ..... 297/45

FOREIGN PATENT DOCUMENTS

GB 2225715 A * 6/1990 ..... A47C/1/034

* cited by examiner

*Primary Examiner*—Peter M. Cuomo
*Assistant Examiner*—Sarah C. Burnham

(57) ABSTRACT

A foldable chair includes a leg assembly and a reclining back connected together by a pair of joint assemblies. Each joint assembly includes a through hole for receiving a support member of the reclining back, and a through channel for accommodating a control device that adjusts the reclining angle. The control device comprises a spring member and an adjustment block to be engaged and disengaged with a saw-tooth member formed on the lower end of the support member. A control button is connected to a handle of the adjustment block. The reclining angle can be adjusted when the control button is pulled to disengage the adjustment block with the saw-tooth member. The control button may also be coupled with the handle using a coupling device. By having the coupling device, the control button can be pushed to disengage the adjustment block with the saw-tooth member.

11 Claims, 7 Drawing Sheets

FOLDABLE CHAIR WITH RECLINING BACK

FIELD OF THE INVENTION

The present invention relates to a foldable chair, and more specifically to a foldable chair having an adjustable reclining back.

BACKGROUND OF THE INVENTION

Foldable chairs are very popular in recent years. People who love outdoor activities such as camping and watching outdoor sport games usually carry foldable chairs with them. Foldable chairs of various designs have been manufactured for easy porting and carrying around outdoors.

FIG. 7 illustrates an example of a foldable chair. As shown in FIG. 7, a foldable chair generally has a leg assembly 101 that is foldable or collapsible and a seat cloth 102 formed by a piece of strong fabric such as canvas. The leg assembly has a plurality of leg members pivotally connected together by pivot pins as well as joined together by joint members. The seat cloth 102 is mounted on the leg assembly 101. The seat cloth and the leg assembly may be extended up to form a back support. Furthermore, the leg assembly 101 also extends up and two armrests 103 are formed thereon.

The foldable chair provides great convenience for outdoor activities. However, as can be seen in FIG. 7, the back support is constructed by extensions of the leg assembly 101 and the seat cloth 102. As a result, the back support often restrains the back of a person in a straight up position that causes fatigue and discomfort on the back. It is strongly desirable to provide a more comfortable back support so that one would not suffer from back fatigue after sitting on the foldable chair for a period of time.

SUMMARY OF THE INVENTION

The present invention has been made to overcome the above mentioned discomfort of sitting on a foldable chair. The primary object of the invention is to provide a reclining back for a foldable chair. The second object is to provide a reclining back for which the reclining angle is easily adjustable. It is also an object of the invention to provide a low cost reclining angle adjustment mechanism that can be integrated into the foldable chair.

According to this invention, the reclining back comprises two support members that are not direct extensions of the leg members. Each leg member is jointed to a support member by a joint assembly. The joint assembly also accommodates a reclining angle adjustment device for adjusting the reclining angle of the support member. Therefore, the angle of the reclining back can be adjusted according to one's preference for comfort.

The reclining angle adjustment device comprises an adjustment block that can be engaged with a saw-tooth member affixed or formed integrally at the bottom end of the support member. A control device having an elastic member is provided to engage or disengage the adjustment block with the saw-tooth member. When the adjustment block is disengaged with the saw-tooth member, the reclining angle can be adjusted.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
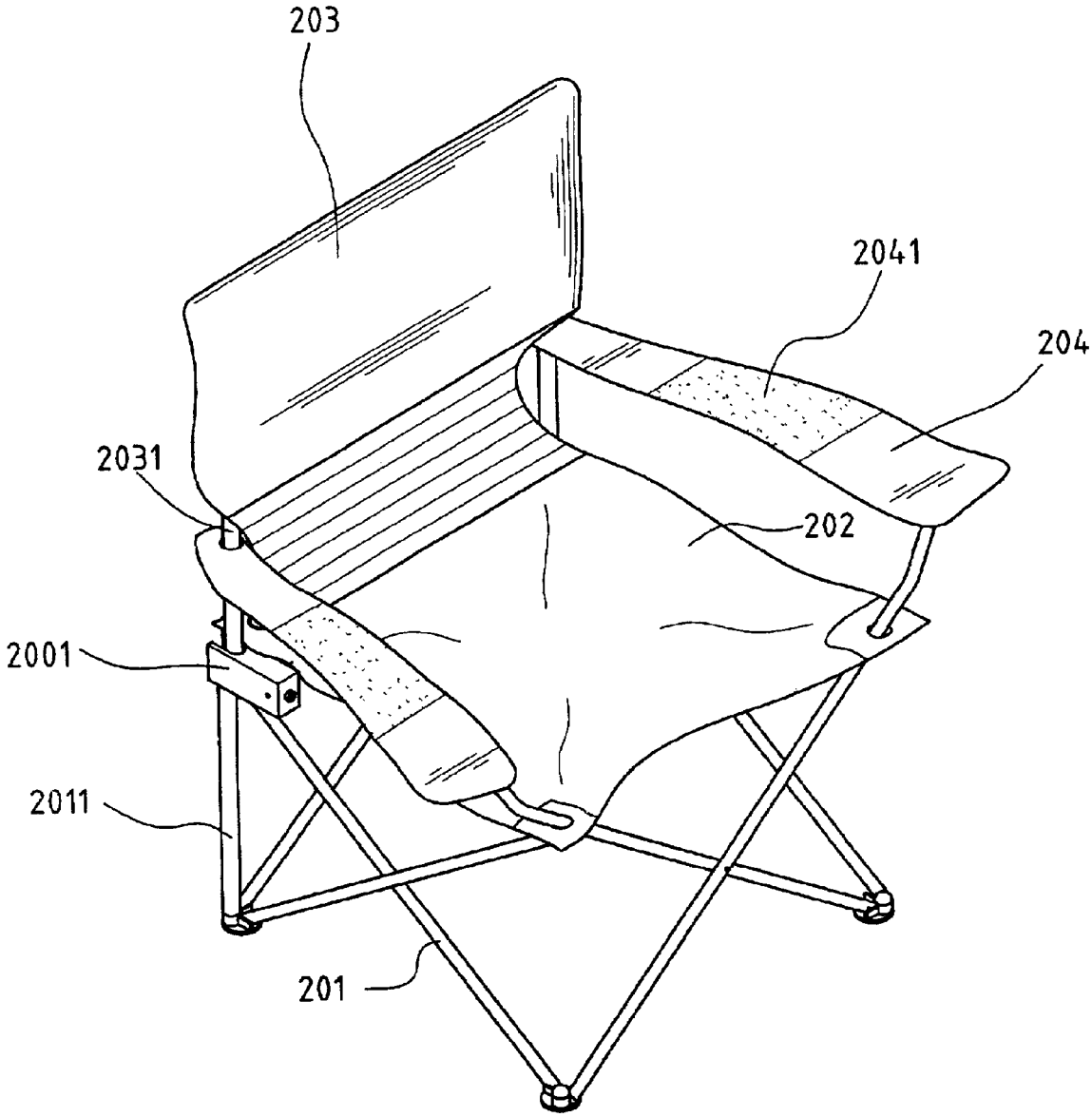
FIG. 1 shows the foldable chair with a reclining back according to this invention.

With reference to FIG. 1, a preferred embodiment of the foldable chair of the present invention comprises a leg assembly 201, a seat cloth 202, a reclining back 203, and a pair of armrests 204. The leg assembly 201 comprises a plurality of rigid leg members hingedly connected together by means of pivotal pins as well as joined together by means of joint connectors.

The seat cloth 202 is mounted on the leg assembly 201. When the leg assembly 201 is opened, the leg assembly 201 forms a chair frame and the seat cloth 202 is also opened up by the leg members to form a seat base. The seat cloth is a piece of strong fabric made of canvas or other synthetic fabric. The reclining back 203 has two support members 2031. The back cloth on the reclining back 203 is an extension of the seat cloth 202 which is affixed to the two support members 2031. Each support member 2031 is jointed to the leg assembly 201 by a joint assembly 2001. In addition to connecting the support member 2031 with the leg assembly 201, the joint assembly 2001 also provides the function of controlling the reclining angle of the reclining back 203.

Figure 2:
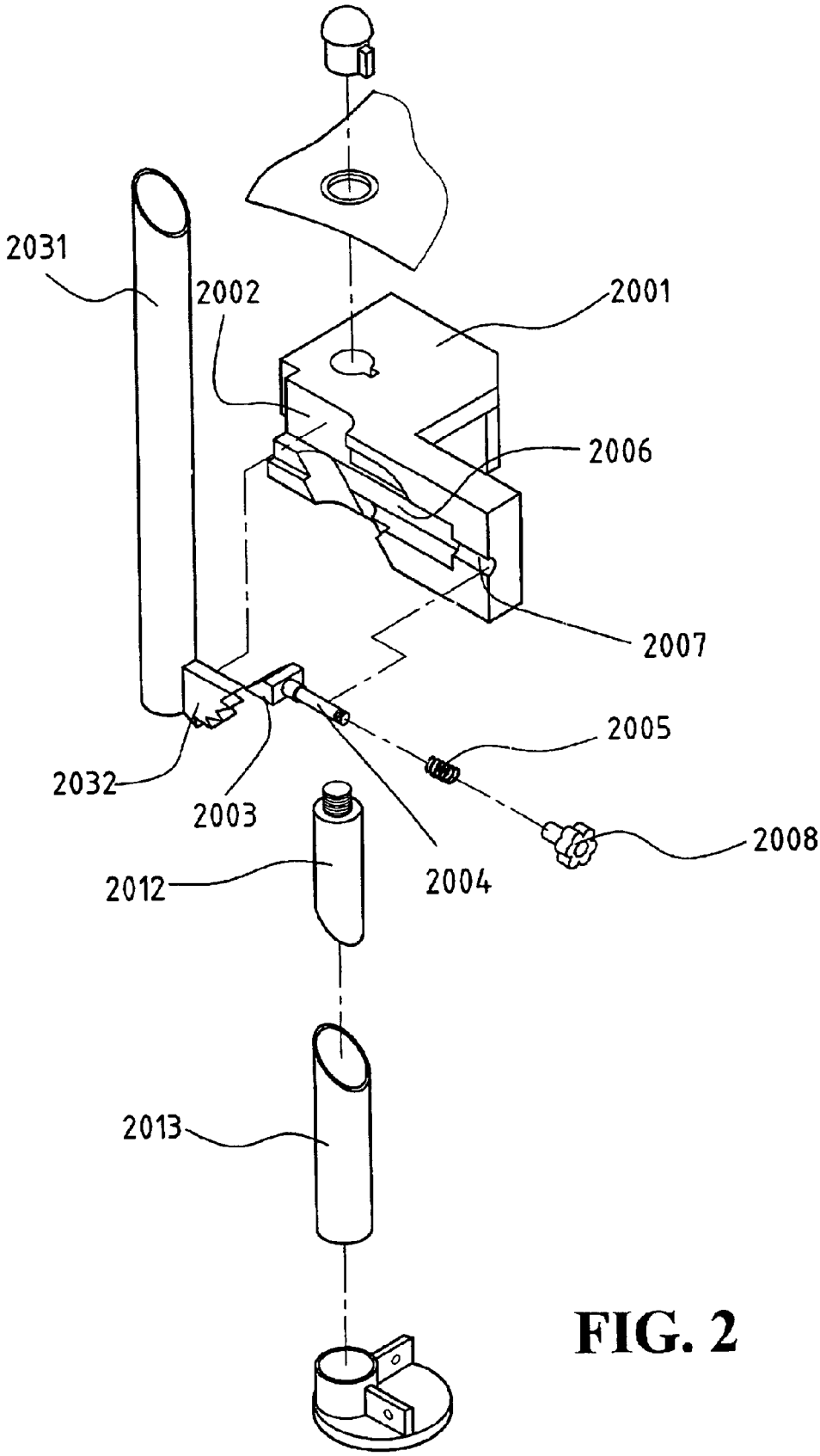
FIG. 2 shows an enlarged, cut-off and decomposed view of the joint assembly according to one embodiment of this invention in which a control button is pulled to adjust the reclining back.

FIG. 2 shows an enlarged, cut-off and decomposed view of the joint assembly 2001 according to one embodiment of the invention. The support member 2031 is received in a through hole 2002 formed in the joint assembly 2001. A saw-tooth member 2032 is integrally formed on the lower end of the support member 2031. The top portion of the through hole 2002 is shaped in such a way that the support member 2031 can be reclined as shown in FIG. 1. The lower end of the support member 2031 is pivotally supported by a pivot pin which has one end affixed on one side wall of the through hole 2002 and the other end affixed on another side wall. The lower portion of the through hole 2002 has sufficient space for the support member 2031 to be reclined and the saw-tooth member 2032 to be rotated in a range.

The joint assembly 2001 includes a control device that comprises an adjustment block 2003, a handle 2004, a spring member 2005 and a control button 2008. A through channel 2006 connected to the through hole 2002 is formed in the joint assembly 2001. The adjustment block 2003 which is disposed in the through channel 2006 can be moved horizontally so as to be engaged with the saw-tooth member 2032 in the lower portion of the through hole 2002. The adjustment block 2003 is integrally formed with the handle 2004 that passes through the spring member 2005 and a side opening 2007 of the through channel 2006 to connect to the control button 2008.

As can be understood from FIG. 2, the spring member 2005 is blocked between the adjustment block 2003 and the side opening 2007. When the control button 2008 is in a natural position, the elastic force of the spring member 2005 pushes the adjustment block 2003 into the through hole 2002. The saw-tooth member 2032 is thus engaged with and blocked by the adjustment block 2003. If the control button is pulled horizontally, the adjustment block 2003 can be disengaged with the saw-tooth member 2032 so that the reclining back 203 and the support member 2031 can be positioned in a reclining angle. After an appropriate reclining angle has been adjusted, the control button 2008 can be released to engage the adjustment block 2003 with the saw-tooth member 2032. The saw-tooth member 2032 has a number of saw-teeth for the engagement with the adjustment block 2003 in different angles.

Figure 3:
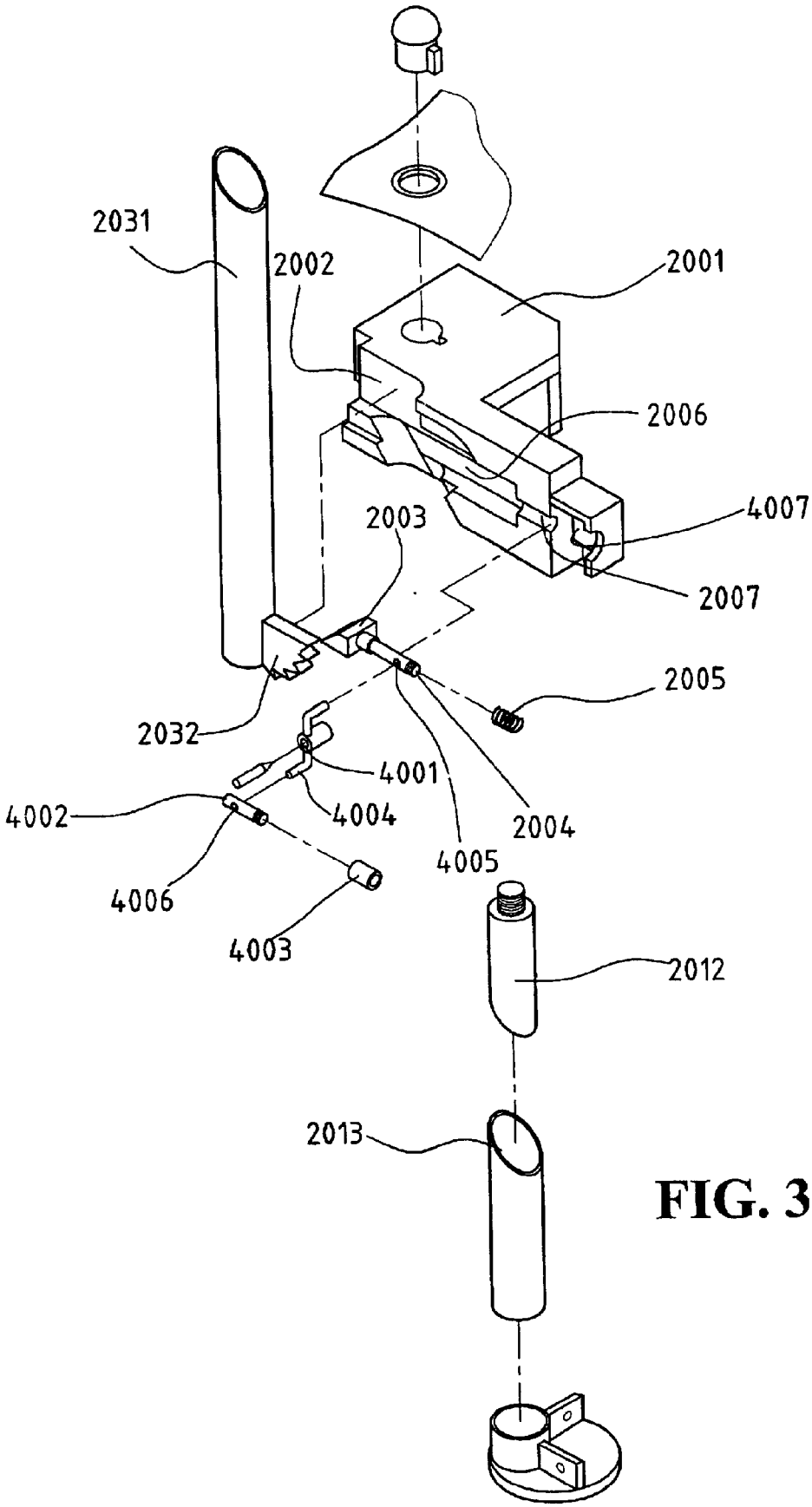
FIG. 3 shows an enlarged, cut-off and decomposed view of the joint assembly according to another embodiment of this invention in which a control button is pushed to adjust the reclining back.

FIG. 3 shows an enlarged, cut-off and decomposed view of the joint assembly 2001 according to another embodiment of the invention. In this embodiment, the joint assembly 2001 includes a control device that comprises an adjustment block 2003, a handle 2004, a spring member 2005, a coupling link 4001, a coupling rod 4002 and a control button 4003. As can be seen from FIG. 3, the control button 4003 is coupled to the handle 2004 by means of the coupling link 4001 and the coupling rod 4002. To adjust the reclining angle of the reclining back in this embodiment, the control button 4003 is pushed in stead of being pulled.

As illustrated in FIG. 3, the coupling link 4001 has two arms 4004. One arm is received in a coupling hole 4005 formed on the handle 2004 and the other arm is received in a coupling hole 4006 formed on the coupling rod 4002 that is connected to the control button 4003. A pivot pin passing through the coupling link 4001 between the two arms 4004 affixes the coupling link 4001 to the structure of the joint assembly 2001. By pushing the control button 4003 towards the joint assembly 2001, the coupling link 4001 is pivotally rotated to move the handle 2004 and the adjustment block 2003 horizontally away from the through hole 2002 so as to disengage with the saw-tooth member 2032. The reclining back 203 can thus be adjusted with different angles until the control button 4003 is released and the elastic force of the spring member 2005 pushes the adjustment block 2003 to engage with and block the saw-tooth member 2032.

The coupling link 4001 and the coupling rod 4002 can be arranged and affixed in the joint assembly 2001 in several ways. In the example shown in FIG. 3, they are housed in a cavity 4007 formed in the joint assembly 2001. The coupling link 4001 is affixed to a side wall of the cavity 4007. The coupling rod 4002 is arranged in parallel with the handle 2004. When the control button 4003 is pushed, the coupling link 4001 is rotated because its lower arm 4004 is coupled to the coupling rod 4002 which is connected to the control button 4003. The rotation of the coupling link 4001 causes its upper arm 4004 to move the handle 2004 and thus the adjustment block 2003 away from the through hole 2002 horizontally.

As can be seen in FIG. 1, the leg assembly 201 includes two rear leg members 2011. Each rear leg member 2011 is connected to the joint assembly 2001 as illustrated in FIG. 2. The rear leg member 2011 comprises an upper leg 2012 and a lower leg 2013. The upper leg 2012 is fastened to the joint assembly 2001. The upper leg 2012 can be received in the lower leg 2013 which has a diameter slightly larger than the upper leg 2012. Therefore, the length of the rear leg member 2011 is adjustable. When the folding chair is folded together, the rear leg member 2011 is extended longer. When the folding chair is opened up, the rear leg member 2011 is shortened by receiving the upper leg 2012 in the lower leg 2013.

Figure 4:
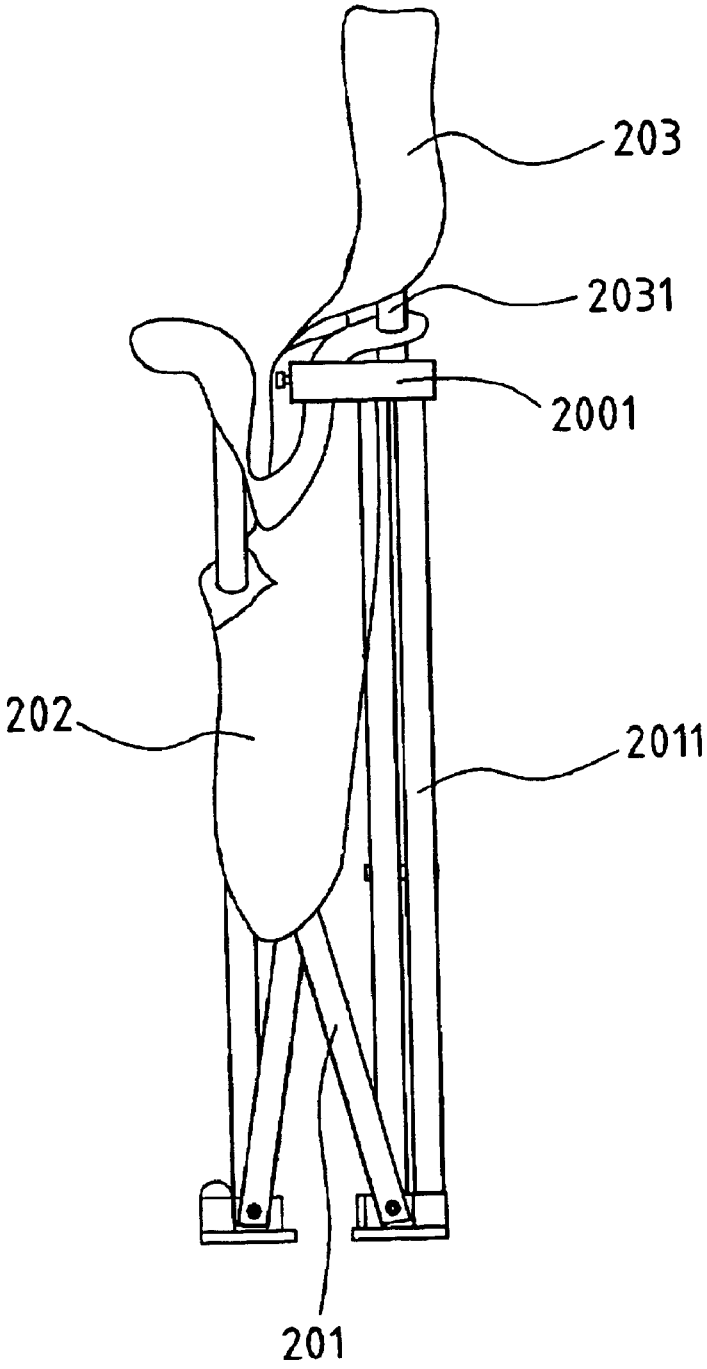
FIG. 4 shows the foldable chair with a reclining back of this invention being folded together for porting.

It is also worth while to point out that when the reclining back 203 of the folding chair is reclined, the length of the armrests 204 has to be extended in order to accommodate the longer distance between the reclining back and the front leg member. Accordingly, each armrest 204 comprises an elastic portion 2041 that can be stretched to adjust the length as illustrated in FIG. 1. In the present invention, the elastic force of the armrests may also restore the reclining back 203 to an upright position when no weight is put on the reclining back. The foldable chair can be collapsed and folded for porting. FIG. 4 shows the foldable chair with a reclining back of this invention being folded together.

Figure 5:
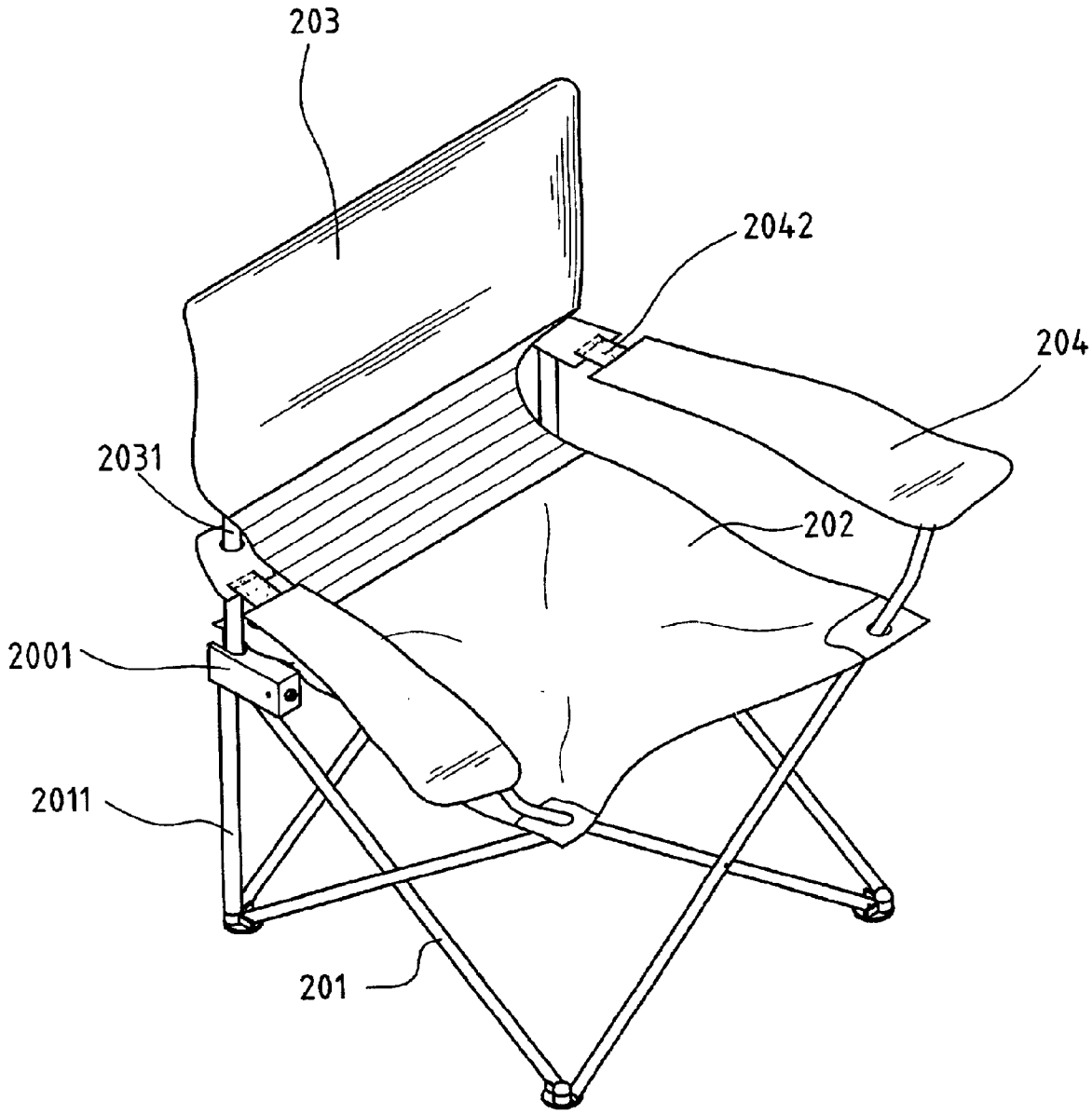
FIG. 5 shows that the elastic portions of the armrests are substantially hidden in enveloped structures of the armrests according to the invention.

In order to make the appearance of the foldable chair more pleasing, the elastic portion 2041 can also be hidden in the armrest. FIG. 5 illustrates an example in which the elastic portion is substantially hidden in the armrest 204. Each armrest 204 has an enveloping structure to accommodate the elastic portion 2042 so that it is almost invisible. The elastic portions extend the length of the armrests when the foldable chair is reclined.

Figure 6:
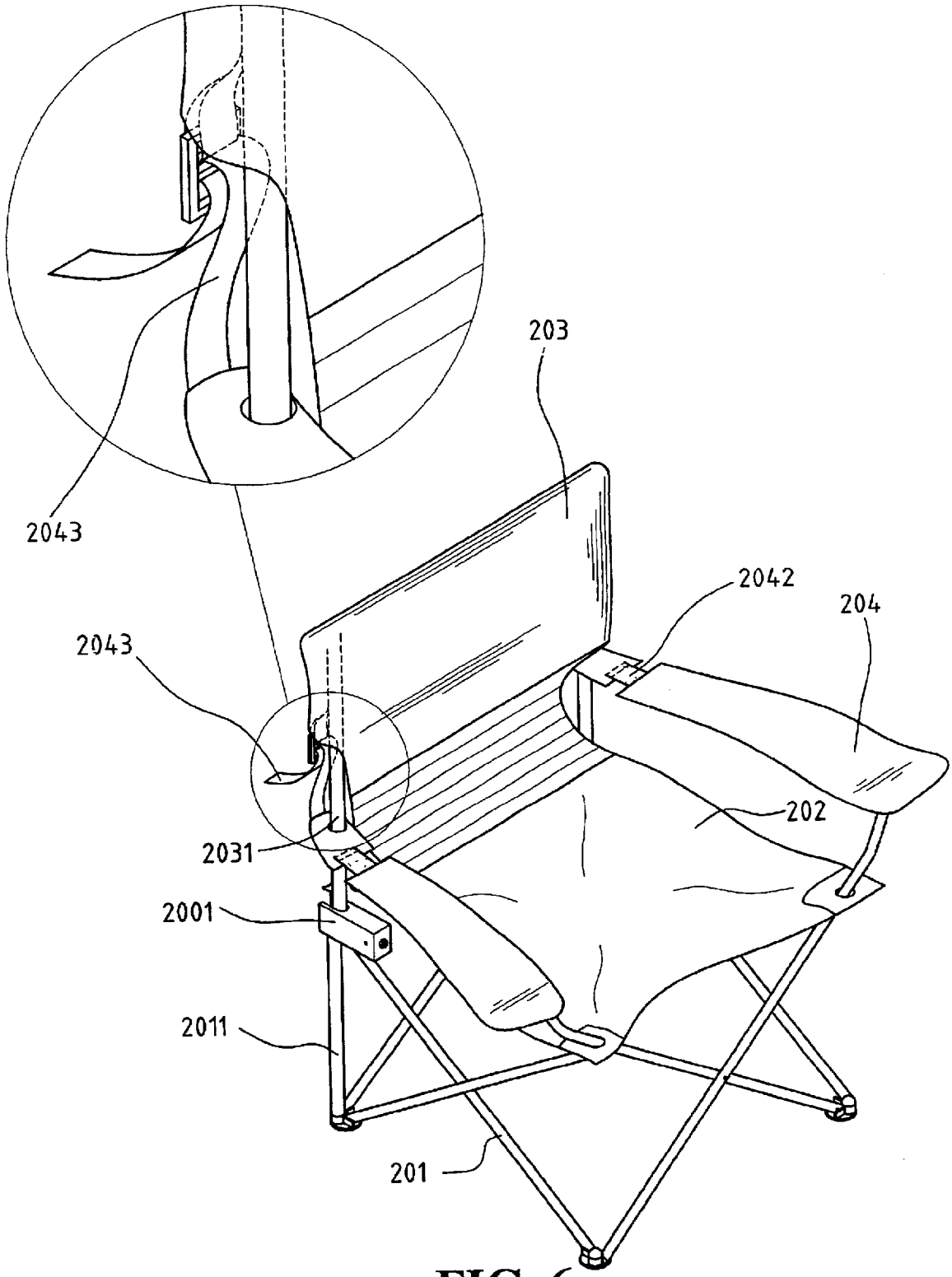
FIG. 6 shows that two adjustable straps connect the two armrests to the reclining back of the foldable chair for adjusting the height of the armrests.
Figure 7:
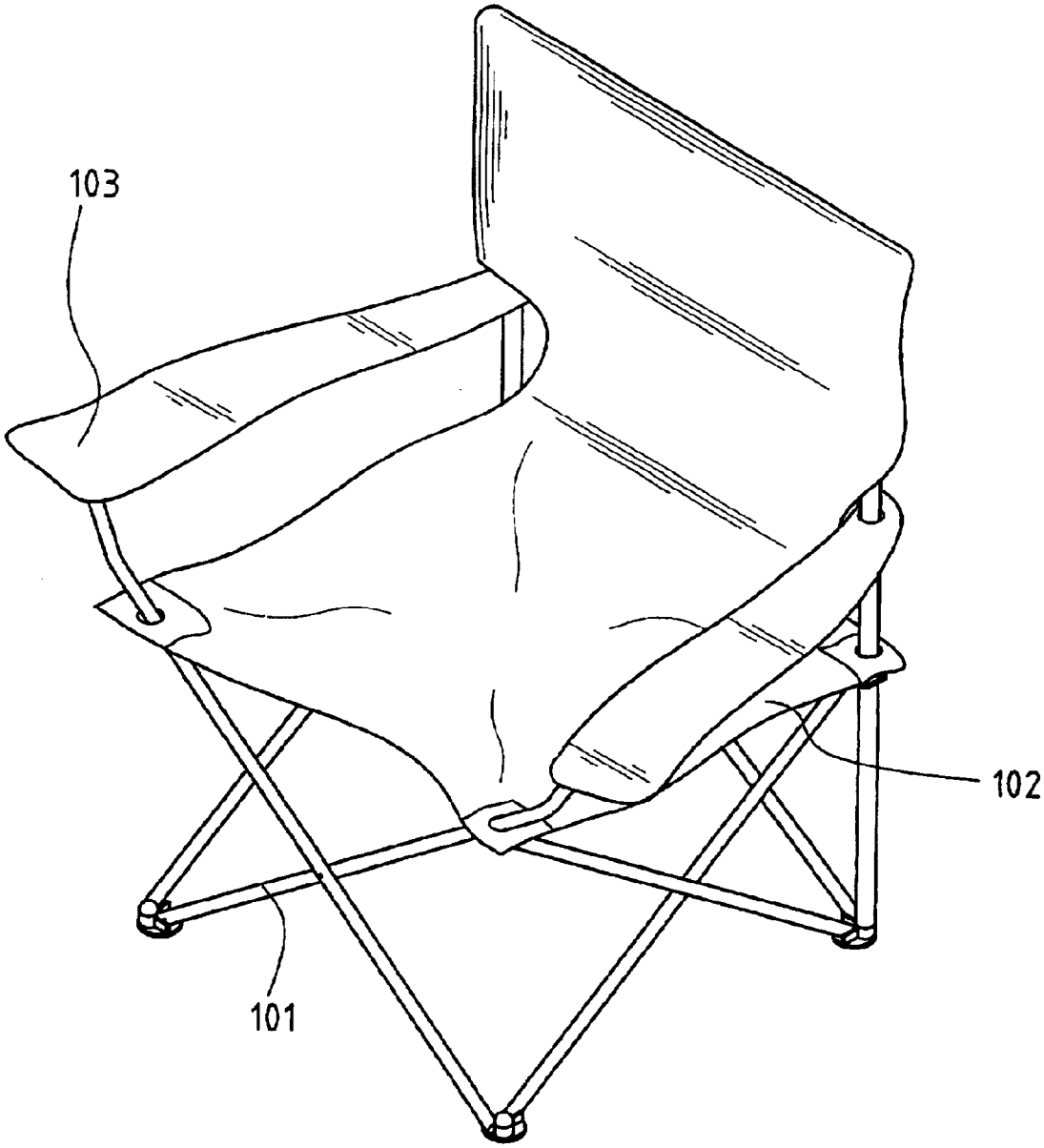
FIG. 7(PRIOR ART)
FIG. 7 shows an example of a conventional foldable chair.

The elastic force of the elastic portion of the armrest 204 also helps restore the reclining back to an upright position when it is desirable. The strength of the elastic force for restoring the reclining back depends on the position of the armrest 204. When the rear ends of the armrests are moved higher, the reclining back 203 is restored to an upright portion more easily. If the rear ends of the armrests 204 are moved very close to the joint assemblies 2001, the reclining back 203 can be maintained in a reclining position because the restoring elastic force is weak. As shown in FIG. 6, this invention also provides straps 2043 that connect the rear ends of the armrests 204 to the reclining back 203. The length of a strap 2043 is adjustable so that the armrest can be positioned higher or lower.

Although only the preferred embodiments of this invention were shown and described in the above description, various modification or combination that comes within the spirit of this invention may also be made by a person skilled in the field according to the principle described.

What is claimed is:

1. A foldable chair comprising:

a reclining back having a pair of support members;

a pair of joint assemblies connected to said support members of said reclining back, each joint assembly having a through hole for receiving a support member, a through channel connected to said through hole, and a control device for engaging and disengaging with a lower end of said support member to control a reclining angle of said reclining back, said control device comprising a control button coupled with a coupling device, a spring member disposed in said through channel, and an adjustment block having a handle passing through said spring member and a side opening of said through channel to couple with said coupling device;

a leg assembly connected to said joint assemblies, said leg assembly being collapsible to form a seat support frame when said leg assembly is fully opened and having a plurality of leg members pivotally connected by pivotal pins and joined together by joint connectors; and a pair of armrests each connecting a support member to an extension of said leg assembly;

wherein said adjustment block is engaged with a saw-tooth member formed on said lower end of said support member when said control button is in a normal position, and said adjustment block is disengaged with said saw-tooth member when said control button is pushed.

2. The foldable chair according to claim 1, wherein said coupling device further comprises:

a coupling rod connected said control button; and a coupling link having a first arm coupled with said coupling rod and a second arm coupled with said handle of said adjustment block.

3. The foldable chair according to claim 2, wherein said coupling device is housed in a cavity formed in said joint assembly, said coupling link is pivotally mounted on a sidewall of said cavity and said coupling rod is disposed in parallel with said handle.

4. The foldable chair according to claim 2, wherein said first arm is coupled with said coupling rod by means of a through hole formed on said coupling rod, and said second arm is coupled with said handle by means of a through hole formed on said handle.

5. The foldable chair according to claim 1, wherein said leg assembly comprises a pair of rear leg members each having an upper leg connected to one of said joint assemblies, and a lower leg, said upper leg being receivable in said lower leg.

6. The foldable chair according to claim 1, further comprising a pair of straps each connecting a rear end of an armrest to said reclining back, said straps having adjustable length.

7. The foldable chair according to claim 1, wherein each armrest includes an elastic portion.

8. The foldable chair according to claim 7, further comprising a pair of straps each connecting a rear end of an armrest to said reclining back, said straps having adjustable length.

9. The foldable chair according to claim 8, wherein elastic force of said pair of armrests restores said reclining back from a reclining position to an upright position when no weight is put on said reclining back and the rear ends of said armrests are adjusted to a higher position by said straps.

10. The foldable chair according to claim 7, wherein said elastic portion is substantially hidden in an envelope structure of said armrest.

11. The foldable chair according to claim 10, further comprising a pair of straps each connecting a rear end of an armrest to said reclining back.

* * * * *